US008782998B2

(12) United States Patent
Goossens et al.

(10) Patent No.: US 8,782,998 B2
(45) Date of Patent: Jul. 22, 2014

(54) STREET POLE AND METHOD FOR PLACING THE STREET POLE

(75) Inventors: Urbanus Paul Marguerite Goossens, Hamme (BE); Albert Maes, Zandhoven (BE); Anja Lievens, Olem (BE); Carolien Willems, Grobbendock (BE)

(73) Assignee: Safety Product, Beringen (BE)

( * ) Notice: Subject to any disclaimer, the term of this patent is extended or adjusted under 35 U.S.C. 154(b) by 0 days.

(21) Appl. No.: 12/137,800

(22) Filed: Jun. 12, 2008

(65) Prior Publication Data

US 2008/0308707 A1 Dec. 18, 2008

(30) Foreign Application Priority Data

Jun. 15, 2007 (BE) ..... 2007/0300
Mar. 31, 2008 (EP) ..... PCT/EP2008/053853

(51) Int. Cl.
*E04H 12/00* (2006.01)

(52) U.S. Cl.
USPC ..... 52/843; 52/834

(58) Field of Classification Search
USPC ..... 52/745.17, 831, 834, 170, 98, 843; 404/10
See application file for complete search history.

(56) References Cited

U.S. PATENT DOCUMENTS

| | | | | |
|---|---|---|---|---|
| 3,552,073 | A * | 1/1971 | Millerbernd | 52/98 |
| 3,798,867 | A * | 3/1974 | Starling | 52/834 |
| 4,248,025 | A * | 2/1981 | Kleine et al. | 52/845 |
| 4,644,715 | A * | 2/1987 | Burell et al. | 52/170 |
| 4,738,058 | A * | 4/1988 | Svensson | 52/98 |
| 5,060,437 | A * | 10/1991 | Parsons et al. | 52/298 |
| 5,481,835 | A * | 1/1996 | Bloom | 52/98 |
| 5,887,842 | A * | 3/1999 | Granger | 248/548 |
| 6,099,203 | A * | 8/2000 | Landes | 404/10 |
| 6,293,313 | B1 * | 9/2001 | McCrink | 138/172 |
| 6,408,590 | B1 * | 6/2002 | Cote | 52/848 |
| 6,560,906 | B1 * | 5/2003 | Hillstrom | 40/607.01 |
| 6,679,469 | B1 * | 1/2004 | Vega | 248/548 |
| 2005/0102960 | A1 * | 5/2005 | Auman | 52/720.1 |
| 2005/0196235 | A1 * | 9/2005 | Strick | 404/10 |

FOREIGN PATENT DOCUMENTS

| | | |
|---|---|---|
| AU | 77732/81 B | 9/1985 |
| DE | 839 087 C | 8/1952 |
| FI | 923834 | 3/1994 |
| WO | 2006/093415 A1 | 9/2006 |

* cited by examiner

*Primary Examiner* — Jeanette E Chapman
*Assistant Examiner* — James Buckle, Jr.
(74) *Attorney, Agent, or Firm* — Sughrue Mion, PLLC

(57) ABSTRACT

A street pole (1) extending substantially along a longitudinal direction (8) and comprising a hollow cylindrical body (6) extending around the longitudinal direction (8) along a circumferential direction (9), the hollow cylindrical body (6) comprising at least one overlap (2) of a first (3) and a second edge (4) of a circumferential side wall (7) forming the hollow cylindrical body (6), the hollow cylindrical body (6) comprising fastening means (5) for interconnecting the first and the second edge (3, 4), the overlap (2) having a length (10) extending substantially parallel along the longitudinal direction (8), wherein the overlap (2) has a width (11) extending substantially along the circumferential direction (9).

19 Claims, 3 Drawing Sheets

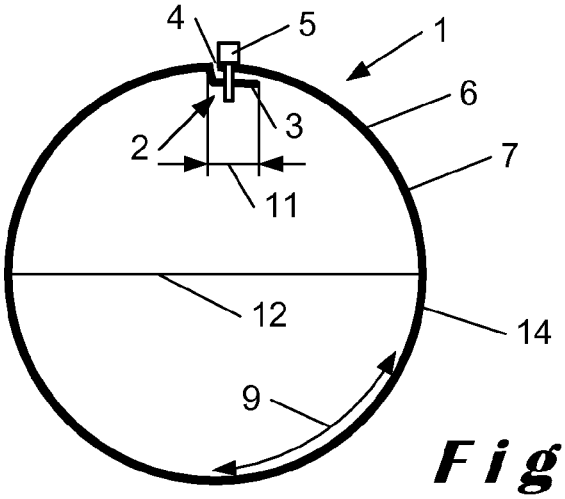
Fig. 2
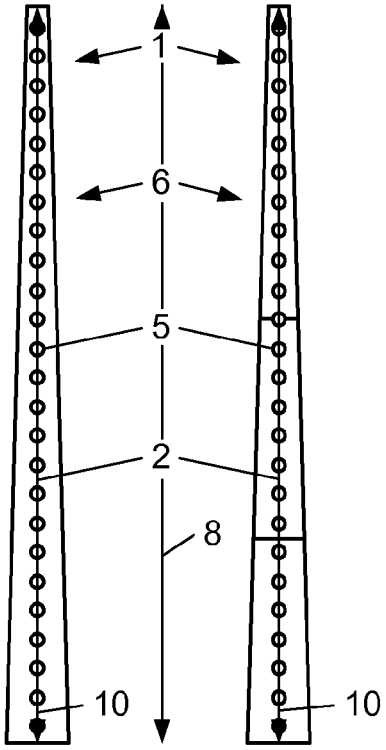
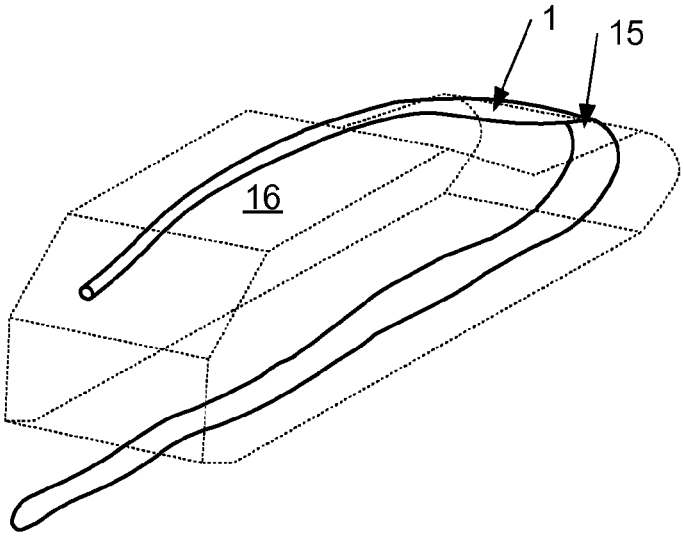
Fig. 5
Fig. 3 Fig. 4

STREET POLE AND METHOD FOR PLACING THE STREET POLE

FIELD OF THE INVENTION

This invention relates to street poles according to the preamble of the first claim.

This invention also relates to a method for placing the street pole.

BACKGROUND

Street poles are already well known in the art. They extend along a longitudinal direction from a first end to a second end, the first end being provided to be fixed to the ground and the second end being provided with for example lighting means, creating a street light. The second end can however also be provided with for example traffic lights or general traffic signals, such as road signs, traffic signs, etc. The street poles generally consist of a metal hollow cylindrical body which extends around the longitudinal direction along a circumferential direction. The metal hollow cylindrical body generally consists of at least one metal sheet which is bent such as to form a circumferential side wall forming the hollow cylindrical body, which can have a round or polygonal cross-section. Adjacent edges of the metal sheet(s) forming the hollow cylindrical body are then interconnected to each other using fastening means.

The edges are hereto for example bent perpendicularly with respect to the hollow cylindrical body towards the outside or the inside of the hollow cylindrical body such that adjacent overlapping flanges are created. The overlap however has a width which extends perpendicular to the circumferential direction. The overlapping flanges can be interconnected by a wide variety of fastening means such as by welding, bolting, soldering, etc. When the flanges are provided on the outside of the hollow cylindrical body the flanges protrude from the cylindrical hollow body, which is not attractive from an aesthetic point of view and can cause injuries to people passing the pole. When the flanges are provided on the inside of the hollow cylindrical body, the flanges are difficult to reach and are therefore difficult to interconnect with the fastening means so that manufacturing of the street pole is more difficult.

An example of a street pole having inwardly bent flanges is shown in FI94890B.

The street poles according to the state of the art therefore have a configuration of the first and the second edges which does not allow a satisfying interconnection of the first and second edges.

SUMMARY OF THE INVENTION

There is thus a need for a street pole in which the interconnection of the first and second edges with fastening means can be improved.

Thereto, the overlap has a width extending substantially along the circumferential direction.

The inventor has found that a street pole having such an overlap allows for interconnecting the first and the second edge by a wide range of different fastening means such as welding, soldering, bolts, rivets, screws, staples, gluing, etc. The street pole according to the invention moreover is aesthetically attractive and is safer for people passing the street pole since it does not have a protruding flange.

Another option for fastening the adjacent metal sheet(s) which is known from the state of the art is by bending metal sheet(s) such that the adjacent edges become collinearly touching each other. Interconnecting the collinearly touching adjacent edges is however difficult and in order to achieve a sufficient interconnection of the first and the second edges is limited to welding and for example no bolts can directly be used in this interconnection. In other words, the fastening means are limited to welding. When the metal sheets are coated with zinc, for example by galvanizing, before being bended and interconnected to form the street pole, the adjacent edges can no longer, or least with increased difficulty, be welded together. So instead, the collinearly touching adjacent edges need to be welded together before coating with for example zinc and can only be galvanised after the first and the second edge have been welded together, which is more difficult and hence more costly. Since the street pole according to the current invention comprises an overlap of the first and the second edge, this problem can be solved by using other fastening means than welding, such as for example, bolts, nails, rivets, screws or the like since the fastening means of the street pole according to the current invention are no longer limited to welding.

In a preferred embodiment of the street pole according to the invention the side wall and the fastening means are provided to split open along the overlap by breaking away the fastening means upon impact at a place of impact on the street pole, the hollow cylindrical body, being provided at the place of impact.

Such a street pole is designed to absorb an impact of for example a vehicle, such that the kinetic energy of an object, for example a vehicle, impacting the street pole preferably is substantially absorbed by the street pole by deformation of the street pole due to the impact in stead of for example deformation of the object, which is, in case of for example a vehicle, hazardous for the occupants of the vehicle. It has been found that accidents involving such a street pole impacted by a vehicle have a reduced mortality rate than accidents involving a street pole which does not absorb the energy of the impact with the vehicle. A street pole having the ability to absorb a significant amount of energy of an impact with a vehicle is generally called a street pole which is passively safe.

A street pole designed to absorb the energy of an impact with a vehicle is for example described by FI94890B. The street pole according to FI94890B however does not comprise the overlap of the street pole of the current invention, having a width which extends substantially along the circumferential direction, but instead has an inwardly bent flange, as described above. When a vehicle impacts the street pole according to FI94890B, the fastening means are provided to break away from the overlap and the overlap as a further consequence splits open. However, it has been found that the rigidity of the street pole according to FI94890B generally remains too large during impact with the vehicle such that an insufficient amount of energy is absorbed by the street pole, which increases the amount of energy which needs to be absorbed by the car, causing an increased risk of mortality and/or injuries to occupants of the vehicle.

The overlap of the street pole of the current preferred embodiment however allows for an improved absorption of kinetic energy of the vehicle. Without wanting to be bound by any theory the inventor believes that this is caused by the direction of the width of the overlap, being substantially along the circumferential direction. It has been found that the impact of the vehicle onto the place of impact causes the hollow cylindrical body to collapse in direction of the impact. As a consequence a first part and a second part of the side wall of the hollow cylindrical body, the second part opposing the first part along the direction of the impact are pushed together in direction of the impact and a third and a fourth part of the side wall of the hollow cylindrical body, the fourth part opposing the third part along a direction substantially perpendicular to the direction of the impact, are pushed away from each other. The relative movement of the first, second, third and fourth part causes the two edges to move in opposite directions along the width direction of the overlap so that the street pole splits open in longitudinal direction along the overlap by breaking away the fastening means.

The inventor has found that such an opposing movement of the edges causes the rigidity of the street pole to drop significantly upon impact, which increases the amount of energy which can be absorbed by the street pole of the current invention. Without wanting to be bound by any theory the inventor believes that the opposing movement of the edges along the width direction of the overlap causes a shear effect which causes an improved breaking away of the fastening means.

The inventor also found that the rigidity of the street pole of the current invention which has not been impacted remains substantially the same. The street pole according to the current invention in other words allows the rigidity of the street pole to be significantly reduced during impact whereas sustaining the rigidity of the street pole before impact.

In a more preferred embodiment of the street pole according to the current invention the fastening means are rivets.

The inventor has found that by interconnecting the two edges with rivets, the interconnecting of the two edges becomes increasingly easy and even edges of for examples galvanised steel can for example be interconnected. Moreover, although the rivets provide the unimpacted street pole with sufficient rigidity, the rivets are also more easily broken away by the opposing movement of the edges along the width of the overlap during impact so that the amount of energy absorbed by the street pole is further increased, improving the passive safety of the street pole.

The invention also relates to a method for placing a street pole according to the invention, wherein the side wall and the fastening means are provided to split open along the overlap by breaking away the fastening means upon impact at a place of impact on the street pole, the hollow cylindrical body, being provided at the place of impact, wherein the width of the overlap extends substantially along a direction substantially parallel to a direction of oncoming traffic.

The inventor has found that when such a positioned street pole is hit by a vehicle moving substantially along the direction of oncoming traffic, the opposing movements of the first and second edge along the width direction of the overlap is further increased, resulting in an improved absorption of the kinetic energy of the vehicle by the street pole.

Other details and advantages of the street pole according to the invention and the method for placing the street pole according to the invention will become apparent from the enclosed figures and description of preferred embodiments of the invention.

BRIEF DESCRIPTION OF THE DRAWINGS

FIG. 2 shows a cross-section of a different embodiment of the street pole according to the invention.

FIG. 3 shows a preferred embodiment of a street pole according to the invention.

FIG. 4 shows a different embodiment of a street pole according to the invention.

FIG. 5 shows a street pole according to the invention which has been impacted by a vehicle.

DETAILED DESCRIPTION OF THE PREFERRED EMBODIMENTS

Figure 1:
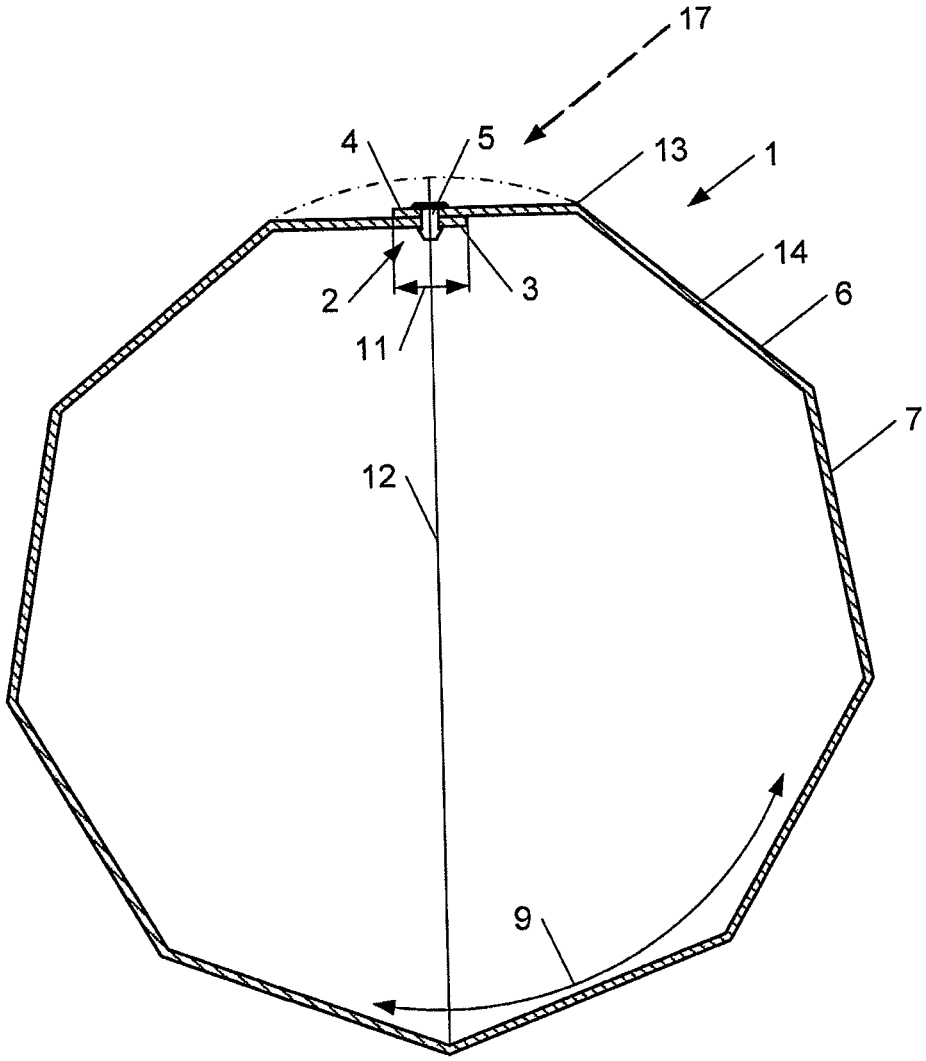
FIG. 1 shows a cross-section of a preferred embodiment of the street pole according to the invention.

A street pole 1 according to the invention is shown in FIGS. 3 and 4. The street pole 1 shown in FIGS. 3 and 4 is fixed to the ground. The street pole 1 can be fixed to the ground in any way known to the person skilled in the art. The street pole 1 can for example be dug into the ground, bolted to the ground, etc. When fixed to the ground the street pole 1 preferably extends in a substantial upright, preferably vertical, direction as shown in FIG. 3. The street pole 1 can however also be provided to be fastened to for example the wall of a building or the like, extending in a substantial horizontal direction.

The street pole 1 shown in FIGS. 3 and 4 extends substantially along a longitudinal direction 8. The longitudinal direction 8 extends between a first and a second end.

The first end is provided to be fastened to a substrate. In FIGS. 3 and 4 the substrate shown, is substantially horizontal. The substrate can however also extend substantially vertically or any other direction. As discussed above, the substrate can for example be the ground, a wall of a building, etc.

The first end can for example be provided to be dug into the ground. The first end can moreover be provided to be put at least partly in cement. However, other known ways for fastening the first end to the substrate can be used such as for example bolting the first end to the substrate.

The first end preferably comprises means for allowing electrical wires to enter the street pole 1, for example to provide electricity to lighting or any other electrically powered means. Thereto, the first end comprises for example an opening leading towards the interior of the street pole 1. This is however not critical for the invention and the electrical wires can for example also be provided along the exterior of the street pole 1.

The second end is provided to be provided with means such as for example lights, street signs, traffic signs, traffic lights, directions, billboards, etc. The second end for example can be provided with one, two, three, four or even more horizontally bent arms, each arm comprising lighting means, creating a lighting pole which can be used along streets or highways to illuminate the streets or highways.

The street pole 1 can have any shape and dimension which is deemed appropriate by the person skilled in the art. The longitudinal direction 8 of the street pole 1 shown in FIGS. 3 and 4 is substantially straight. However, the street pole 1 can for example be bent along its longitudinal direction 8, for example when it is provided to be mounted to an upright substrate.

The street pole 1 comprises a hollow cylindrical body 6. The hollow cylindrical body 6 extends around the longitudinal direction 8 along a circumferential direction 9. A cross section of such a hollow cylindrical body 6 is for example shown in FIGS. 1 and 2.

The hollow cylindrical body 6 can be provided anywhere along the longitudinal direction 8 of the street pole 1. The street pole 1 can for example comprise a first longitudinal part not being hollow but being solid, for example, wood, plastic, etc., and a second longitudinal part being formed by at least one hollow cylindrical body 6. The first and second longitudinal part can be provided anywhere along the longitudinal direction 8 such that the first longitudinal part is provided near the first end and the second longitudinal part is provided near the second end, but preferably the first longitudinal part is provided near the second end and the second longitudinal part is provided near the first end. It is preferred that the street pole 1 is made of at least one hollow cylindrical body 6. FIG. 4 shows for example a street pole 1 being made of different subsequent hollow cylindrical bodies 6. Preferably, the street pole 1 however is made of a single hollow cylindrical body 6, as shown in FIG. 3.

The inventor has found that when the street pole 1 is made of a single hollow cylindrical body 6, the street pole 1 can be easily made.

The hollow cylindrical body 6 can be made of any material such as plastic, wood, metal such as for example aluminium, steel, stainless steel, galvanised steel, etc.

The cylindrical body 6 can have any shape and dimensions deemed appropriate by the person skilled in the art.

The dimensions of the hollow cylindrical body 6 preferably are substantially determined by its length and its diameter 12. The length of the cylindrical body is measured along the longitudinal direction 8 of the street pole 1, whereas the diameter 12 is defined as the diameter of an arc defining the circumferential direction 9 of the hollow cylindrical body 6, as shown in FIGS. 1 and 2.

The length of the hollow cylindrical body 6, as discussed above, preferably substantially equals the length of the street pole 1. The diameter 12 of the hollow cylindrical body 6 can be determined by the person skilled in the art. However, the length of the hollow cylindrical body 6 can also be substantially longer or shorter than the length of the street pole 1.

The shape of the hollow cylindrical body 6 is substantially determined by the shape of the cross section of the hollow cylindrical body 6. Two examples of shapes of cross sections, polygonal and round, are respectively shown in FIGS. 1 and 2. Any other shape of the cross section is however possible and can be determined by the person skilled in the art such as for example, a regular or irregular polygon having 3, 4, 5, 6, 7, 8, 9, 10, 11, 12, 13, 14, 15, 16, 17, 18, 19, 20 or even more vertices 13, an arcuate shape such as an ellipsoid, etc.

The cross section of the hollow cylindrical body 6 can change along the length direction of the hollow cylindrical body 6. The cross section can for example become larger or smaller along the length direction or can remain substantially constant.

Preferably, the cross section of the hollow cylindrical body 6 becomes smaller in a direction from the first end of the street pole 1 towards the second end of the street pole 1, as shown in FIGS. 3 and 4, when the hollow cylindrical body 6 has a polygonal cross section.

Preferably, the cross section of the hollow cylindrical body 6 is substantially constant along the longitudinal direction 8 of the street pole 1 when a round cross section is used as shown in FIG. 2.

The hollow cylindrical body 6 comprises a circumferential side wall 7 forming the hollow cylindrical body 6. The circumferential side wall 7 comprises a first 3 and a second 4 edge which overlap to form an overlap 2. A top view of the overlap 2 is for example shown in FIGS. 1 and 2. The overlap 2 has a length 10 which extends substantially along, preferably parallel to, the longitudinal direction 8, as shown in FIGS. 3 and 4. The length 10 of the overlap 2 can however extend along any possible direction extending substantially along the longitudinal direction 8.

The circumferential side wall 7 can be a single piece or can be made of different pieces. The circumferential side wall 7 preferably is made of a single piece since the inventor has found that such a hollow cylindrical body 6 can be more easily made. However, the hollow cylindrical body 6 can also be made of a multitude of pieces which can be adjoined using any method known in the art such as welding, soldering, gluing, stapling, bolting, screwing, riveting, etc.

The overlap 2 can be positioned on every location along the circumferential side wall 7. However, when the hollow cylindrical body 6 has a polygonal cross section, the overlap 2 preferably is provided in between two adjacent vertices 13 of the polygonal cross section. The overlap 2 more preferably is provided substantially equidistant from the two adjacent vertices 13. The overlap 2 can however be provided at every location deemed appropriate by the person skilled in the art such as for example at or near a vertex 13.

The hollow cylindrical body 6 can comprise several overlaps 2 but preferably comprises a single overlap 2 as shown in FIGS. 1 and 2. The inventor has found that by providing the hollow cylindrical body 6 with a single overlap 2, the hollow cylindrical body can be more easily manufactured.

The hollow cylindrical body 6 comprises fastening means 5 for interconnecting the first 3 and second 4 edge of the circumferential side wall 7. Any fastening means 5 known to the person skilled in the art can be used for example bolts, nuts, rivets, screws, nails, staples, glue, welds, solderings, etc.

When the overlap 2 of the first 3 and the second 4 edge causes one of the first 3 and the second 4 edge to be pressed to the other edge 3, 4, for example due to a resilient force remaining after bending of the edges in the desired overlapping configuration, the friction caused by the pressing of one edge to the other may cause that a sufficient interconnection of the first 3 and the second 4 edge is reached. In that case the fastening means 5 are the cooperating first 3 and second 4 edge and no additional bolts, nuts, rivets, screws, nails, staples, glue, welds, solderings, etc. are necessary. In this case breaking away the fastening means 5 means that the friction between the first 3 and the second 4 edge is overcome and that first 3 and the second 4 edge are allowed to move in opposite directions along the width direction of the overlap 2.

The fastening means 5 are preferably provided along the entire length 10 of the overlap 2, more preferably on regular distances when for example nuts, bolts, screws, nails, staples or the like are used or preferably along the entire length 10 of the overlap 2 when for example cooperating first 3 and second 4 edges, glue, welds, solderings, or the like are used. Other configurations of the fastening means 5 are however possible.

The overlap 2 has a width 11 which extends substantially along the circumferential direction 9. The first 3 and the second 4 edge of the circumferential side wall 7 in other words overlap each other along the circumferential direction 9. The width 11 is for example shown in FIGS. 1 and 2.

The width 11 of the overlap 2 can be determined by the person skilled in the art. Preferably, the width 11 of the overlap is determined in function of the fastening means 5. For example, when rivets, bolts, nails, screws, staples, etc. are used to interconnect the first 3 and the second 4 edge of the hollow cylindrical body 6, the width 11 needs to be sufficient to receive the fastening means 5 and to offer a sufficient interconnection of the first 3 and the second 4 edge. When using other fastening means 5 such as for example glue, welds, solderings, etc. the width 11 needs to be adapted to the interconnecting characteristics of the fastening means 5 such that the width 11 needs to be increased or can be decreased in order to offer a sufficient interconnection of the first 3 and the second 4 edge.

The width 11 can for example be as small as 1 mm for some types of fastening means 5 or the width 11 can extend up to more than 100% of the circumference of the hollow cylindrical body 6 in which case the side wall 7 comprises at least two layers wound around the longitudinal direction of the street pole 1.

The inventor has found that an increased width 11 of the overlap 2, increases the friction between the first 3 and the second 4 edge of the overlap 2 so that additional fastening means 5 such as bolts, nuts, rivets, screws, nails, staples, glue, welds, solderings, etc. can be avoided.

Preferably, the width 11 of the overlap 2 is substantially constant along the longitudinal direction 8 of the street pole 1. This is however not critical for the invention and the width 11 can change along the longitudinal direction 8 of the street pole 1.

The hollow cylindrical body 6 preferably is made of a bendable material such as for example metal. This way the hollow cylindrical body 6 can be made by bending a sheet 14 of the bendable material, preferably a metal sheet, into the desired shape having the desired cross section. However, any other material is possible as described above and the hollow cylindrical body 6 can for example also be cast.

In case the hollow cylindrical body 6 has a polygonal cross section, more preferably a regular polygonal cross section, as shown in FIG. 1, the hollow cylindrical body 6 preferably is made by bending at least one sheet 14 of the bendable material along longitudinal folding lines forming the vertices 13 of the polygonal cross section. Preferably, these folding lines are created by pushing a longitudinal edge into and/or along the sheet of bendable material. Any other way of making the hollow cylindrical body is however possible.

More preferably, the hollow cylindrical body 6 in this case has an uneven number of vertices and the overlap 2 is provided in between two adjacent vertices 13, the last folding line being created being the folding line opposing the overlap 2. The inventor has found that such bending of the sheet 14 of bendable material allows the longitudinal edge to be retracted more easily, after being pushed into and/or along the sheet 14 of bendable material in order to create the folding line, in between the first 3 and the second 4 edge before the overlap 2 is created.

In case the hollow cylindrical body 6 has a round cross section, the hollow cylindrical body 6 preferably is made by rolling at least one sheet 14 of bendable material, preferably metal.

Although the hollow cylindrical body 6 preferably is made of a single bent sheet 14, as shown in FIGS. 1 and 2, the hollow cylindrical body 6 can also be made of several bent sheets 14 forming the different pieces of the circumferential side wall 7, as discussed above.

Preferably, the side wall 7 and the fastening means 5 are provided to split open along the overlap 2 by breaking away the fastening means 5 upon impact at a place of impact 15 on the street pole 1, the hollow cylindrical body 6, being provided at the place of impact 15.

Preferably, the side wall 7 and the fastening means 5 are provided to split open along the overlap 2 by breaking away the fastening means 5 upon impact with a vehicle 16. The vehicle 16 can be any vehicle 16, preferably motorised, known to the person skilled in the art such as a car, truck, motorcycle, etc.

This is especially beneficial for street poles 1 which are provided to be fixed to the ground since such poles 1 are generally provided next to roads on which traffic passes to street pole 1.

With impact in the context of this application is meant an impact caused when such a vehicle 16 drives into the street pole 1 for example more than 0 km/h, more than 5 km/h, more than 10 km/h, more than 20 km/h or more than 30 km/h or even higher. However, the side wall 7 and the fastening means 5 must be such as to resist normal forces acting on the street pole 1 such as for example varying winds, relative small impacts caused by for example parking vehicles, etc. when the street pole 1 has not been impacted by vehicle 16.

Examples of a vehicle impacting such a street pole 1 are shown in FIGS. 5 and 6*a*-6*d*.

When the street pole 1 is impacted, the first 3 and the second 4 edge of the side wall 7 move away from each other as described and the fastening means 5 are broken away from the edges 3, 4. When the impact is large enough, the first and second edge 3, 4 move even further away until subsequent fastening means 5 are broken away. This process is repeated until the impact has been fully absorbed, as shown in FIG. 5. Due to the impact the first and the second edge 3, 4 can keeping moving away from each other until the circumferential sidewall 7 is fully unfolded and becomes substantially flat, as shown in FIG. 5.

Preferably, the street pole 1 is provided not to break away from its substrate upon impact but to remain fixed to its substrate, allowing the energy of the impact to be absorbed until the speed of the vehicle 16 impacting the street pole 1 has been significantly reduced. Therefore, after impact of the vehicle 16 with the street pole 1, the risk that the vehicle 16 impacts a further obstacle after impacting the street pole 1 is significantly reduced. In order to achieve such a connection of the street pole 1 to the substrate, the first end preferably is cast into cement, as discussed above. However, this is not critical for the invention and any other connection of the street pole 1 to the substrate may be used.

Figure 6A:
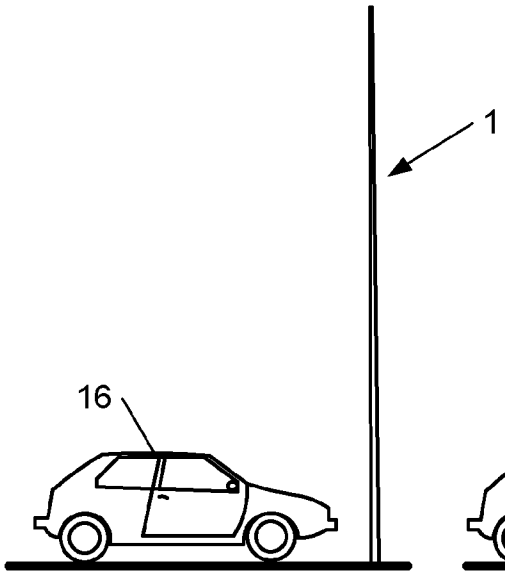
FIGS. 6*a*-6*d* successively show the effect of a vehicle impacting a street pole according to the invention during the impact of the vehicle with the street pole.
Figure 6B:
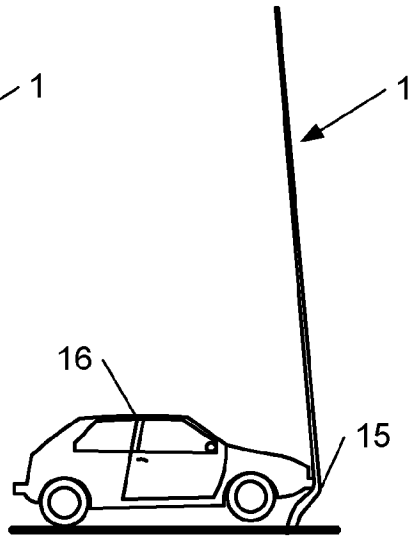
Figure 6C:
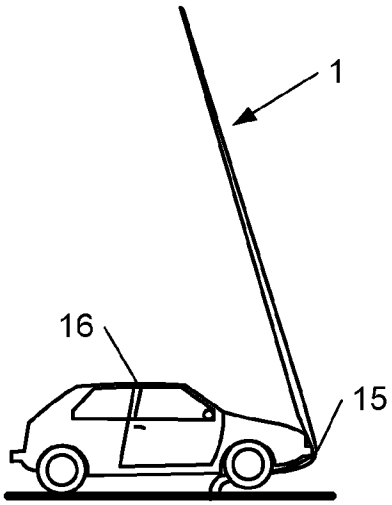
Figure 6D:
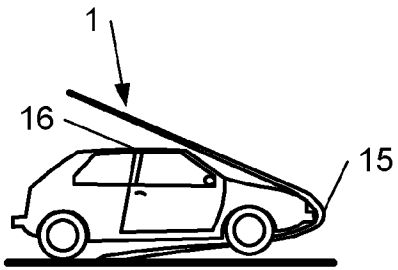

A vehicle 16 impacting the street pole 1 causes the street pole 1 to be impacted at the place of impact 15. The hollow cylindrical body 6 then splits open at the place of impact 15. Subsequently, when the impact is large enough the place of impact 15 moves along the longitudinal direction 8 of the street pole 1 as shown in FIGS. 6*a*-6*d* such that a part of the street pole 1 moves under the vehicle 16 while another part folds in the direction of the vehicle 16, as shown in FIGS. 5 and 6*d*. By keeping the street pole 1 fixed to the ground, the kinetic energy of the vehicle 16 can be absorbed until the speed of the vehicle 16 is reduced. While the place of impact 15 moves along the longitudinal direction 8 of the street pole 1, the first and second edges 3, 4 at the moving place of impact 15 keep moving away from each other along the width direction 11 of the overlap 2 such that the fastening means are broken away and the overlap 2 splits open along the longitudinal direction 8 until the speed of the vehicle 16 has been significantly reduced. Preferably, the speed of the vehicle 16 after impact with the street pole 1 is reduced such that it is less than 50 km/h measured after 12 m after the initial impact.

The part that folds in direction of the vehicle 16 can fold onto the vehicle 16 or, preferably, next to the vehicle 16. When the street pole 1 is provided to fold next to the vehicle the occupants of the vehicle are even more protected.

The hollow cylindrical body 6 must be provided at the place of impact 15 in order to be able to absorb the energy of the impact. Therefore, the hollow cylindrical body 6 provided to split open upon impact is preferably provided at a height which can be impacted by vehicles 16. The hollow cylindrical body 6 is for example provided near the substrate. However, the hollow cylindrical body 6 preferably extends along substantially the entire length of the street pole 1 along the longitudinal direction 8, as shown in FIGS. 3 and 4. When the overlap 2 extends along substantially the entire length of the street pole 1, larger impacts can be absorbed since the absorption of the impact by the splitting open of the hollow cylindrical body 6, the braking away of the fastening means 5 and the unfolding of the hollow cylindrical body 6 can continue along the entire length of the street pole 1. A same effect can also be achieved when the street pole 1 is formed of subsequent hollow cylindrical bodies 6, as shown in FIG. 4.

The hollow cylindrical body 6 in such an embodiment preferably is made from metal, such as for example steel, aluminium, etc. More preferably the hollow cylindrical body 6 is made from steel.

Preferably, material of the side wall 7 of the hollow cylindrical body 6 has a yield strength Re of between 50 $N/mm^2$-700 $N/mm^2$, preferably 200 $N/mm^2$-550 $N/mm^2$, more preferably 330 $N/mm^2$-410 $N/mm^2$.

Preferably, the material of the side wall 7 has a tensile strength Rm of between 50 $N/mm^2$-1350 $N/mm^2$, preferably 350 $N/mm^2$-1050 $N/mm^2$, more preferably 600 $N/mm^2$-700 $N/mm^2$.

Preferably, the material of the side wall 7 has a minimal elongation before breaking A80 of at least 5%, preferably, 15%, more preferably 21%.

Preferably, the side wall 7 has a thickness of between 20 mm-0.5 mm, preferably 10 mm-1 mm, more preferably 5 mm-1 mm, even more preferably 2 mm.

Preferably, the hollow cylindrical body 6 has a diameter 12 at the place of impact 15 of between 50 mm-400 mm, preferably 100 mm-300 mm, more preferably 150 mm-250 mm.

Preferably, the width 11 of the overlap 2 is at least 0.1%, preferably maximal 100%, more preferably between 0.1% and 10%, most preferably between 2% and 3.5% of the circumference of the hollow cylindrical body 6.

A first example is a street pole 1 consisting of a single hollow cylindrical body 6 having a length of about 12 m, a diameter of 240 mm near the first end of the street pole 1 and a substantially constant width 11 of the overlap 2 of 20 mm which is 2.6% of the diameter 12 near the first end.

Another example is a street pole 1 consisting of a single hollow cylindrical body 6 having a length of about 10 m, a diameter of 208 mm near the first end of the street pole 1 and a substantially constant width 11 of the overlap 2 of 20 mm which is 3.06% of the diameter 12 near the first end.

Preferably, the fastening means 5 have a shear strength, this is the strength in width 11 direction of the overlap 2, of between 2000N-7000N, preferably 3000N-6000N, more preferably 4000N-5000N, most preferably 4100N-4500N.

Preferably, the fastening means 5 are rivets since the inventor found that they offer a good and easy interconnection of the first and the second edge 3, 4 while being provided to brake away when the first and the second edge 3, 4 move away from each other and allowing an easy interconnection of the first and the second edge 3, 4. However, any other fastening means 5 can be used instead, as described above.

The invention also relates to a method for placing such a street pole 1 in which the width 11 of the overlap 2 extends substantially along a direction substantially parallel to the direction (17) of oncoming traffic.

More specifically the width 11 of the overlap 2 extends substantially along a direction having an angle of between 0°-90°, 0°-180°, 0°-45°, preferably 10°-30°, more preferably 15°-25°, most preferably 20° with the direction (17) of oncoming traffic.

The overlap 2 can however also be provided in any other possible direction. The street pole 1 can for example be placed such that the width 11 of the overlap 2 extends substantially along a direction which is substantially perpendicular to the direction (17) of oncoming traffic or any other possible direction.

The invention claimed is:

1. A street pole (1) extending substantially along a longitudinal direction (8) and comprising a hollow cylindrical body (6) extending around the longitudinal direction (8) along a circumferential direction (9), the hollow cylindrical body (6) comprising at least one overlap (2) of a first (3) and a second edge (4) of a circumferential side wall (7) forming the hollow cylindrical body (6), the hollow cylindrical body (6) comprising fastening means (5) for interconnecting the first and the second edge (3, 4), the overlap (2) having a length (10) extending substantially parallel along the longitudinal direction (8), wherein the overlap (2) has a width (11) extending substantially along the circumferential direction (9), wherein the side wall (7) and the fastening means (5) are provided to split open along the overlap (2) by breaking away the fastening means (5) upon impact at a place of impact (15) on the street pole (1), the hollow cylindrical body (6), being provided at the place of impact (15), wherein the fastening means (5) are elements extending through the overlap to interconnect the first and the second edges to each other, wherein the impact is caused by a vehicle in an accident, wherein the street pole (1) is provided with one or more lights, street signs, traffic signs, traffic lights, directions, or billboards, wherein the street pole (1) is made of a single hollow cylindrical body (6).

2. A street pole (1) according to claim 1, wherein the material of the side wall (7) has a yield strength (Re) of between 50$N/mm^2$-700$N/mm^2$.

3. A street pole (1) according to claim 1, wherein the material of the side wall (7) has a tensile strength (Rm) of between 50$N/mm^2$-1350$N/mm^2$.

4. A street pole (1) according to claim 1, wherein the material of the side wall (7) has a minimal elongation before breaking (A80) of at least 5%.

5. A street pole (1) according to claim 1, wherein the side wall (7) has a thickness of between 20 mm-0.5 mm.

6. A street pole (1) according to claim 1, wherein the hollow cylindrical body (6) has a diameter (12) at the place of impact (15) of between 50 mm-400 mm.

7. A street pole (1) according to claim 1, wherein the width (11) of the overlap (2) is between 0.1% and 10% of the circumference of the hollow cylindrical body (6).

8. A street pole (1) according to claim 1, wherein the fastening means (5) have a shear strength of between 2000N-7000N.

9. A street pole (1) according to claim 1, wherein the fastening means (5) are rivets.

10. A street pole (1) according to claim 1, wherein the hollow cylindrical body (6) has a round cross-section.

11. A street pole (1) according to claim 1, wherein the hollow cylindrical body (6) has a regular polygonal cross-section.

12. A street pole (1) according to claim 11, wherein the overlap (2) is substantially positioned at the centre between two adjacent vertices (13) of the regular polygonal cross-section.

13. A street pole (1) according to claim 11, wherein the regular polygonal cross-section comprises an uneven number of vertices (13).

14. A street pole (1) according to claim 1, wherein the circumferential side wall (7) forming the hollow cylindrical body (6) comprises at least one bent metal sheet (14).

15. A street pole (1) according to claim 14, wherein the metal sheet (14) is made from steel.

16. A method for improving absorption of kinetic energy of a vehicle by a street pole, comprising providing a street pole (1) extending substantially along a longitudinal direction (8) and comprising a hollow cylindrical body (6) extending around the longitudinal direction (8) along a circumferential direction (9), the hollow cylindrical body (6) comprising at least one overlap (2) of a first (3) and a second edge (4) of a circumferential side wall (7) forming the hollow cylindrical body (6), the hollow cylindrical body (6) comprising fastening means (5) for interconnecting the first and the second edge (3, 4), the overlap (2) having a length (10) extending substantially parallel along the longitudinal direction (8), wherein the overlap (2) has a width (11) extending substantially along the circumferential direction (9), wherein the side wall (7) and the fastening means (5) are provided to split open along the overlap (2) by breaking away the fastening means (5) upon impact at a place of impact (15) on the street pole (1), the hollow cylindrical body (6), being provided at the place of impact (15), wherein the fastening means (5) are elements extending through the overlap to interconnect the first and the second edges to each other, wherein the impact is caused by a vehicle in an accident.

17. A method according to claim 16, wherein the width (11) of the overlap (2) extends substantially along a direction having an angle of between 0°-45° with a direction (17) of oncoming traffic.

18. A street pole (1) according to claim 1, wherein the fastening means (5) comprises nuts, bolts, screws, nails, staples or rivets.

19. A street pole (1) extending substantially along a longitudinal direction (8) and comprising a hollow cylindrical body (6) extending around the longitudinal direction (8) along a circumferential direction (9), the hollow cylindrical body (6) comprising at least one overlap (2) of a first (3) and a second edge (4) of a circumferential side wall (7) forming the hollow cylindrical body (6), the hollow cylindrical body (6) comprising fastening means (5) for interconnecting the first and the second edge (3, 4), the overlap (2) having a length (10) extending substantially parallel along the longitudinal direction (8), wherein the overlap (2) has a width (11) extending substantially along the circumferential direction (9), wherein the side wall (7) and the fastening means (5) are provided to split open along the overlap (2) by breaking away the fastening means (5) upon impact at a place of impact (15) on the street pole (1), the hollow cylindrical body (6), being provided at the place of impact (15), wherein the fastening means (5) are elements extending through the overlap to interconnect the first and the second edges to each other, wherein the impact is caused by a vehicle in an accident, wherein the hollow cylindrical body (6) has a round cross-section, wherein the street pole (1) is provided with one or more lights, street signs, traffic signs, traffic lights, directions, or billboards, wherein the side wall (7) is a single piece.

* * * * *

UNITED STATES PATENT AND TRADEMARK OFFICE

CERTIFICATE OF CORRECTION

PATENT NO. : 8,782,998 B2
APPLICATION NO. : 12/137800
DATED : July 22, 2014
INVENTOR(S) : Urbanus Paul Marguerite Goossens et al.

It is certified that error appears in the above-identified patent and that said Letters Patent is hereby corrected as shown below:

On the Title Page, item (75) should read

(75) Inventors: Urbanus Paul Marguerite Goossens, Hamme (BE); Albert Maes, Zandhoven (BE); Anja Lievens, Olen (BE); Carolien Willems, Grobbendock (BE)

Signed and Sealed this
Fourteenth Day of July, 2015

Michelle K. Lee

Michelle K. Lee
*Director of the United States Patent and Trademark Office*